US006149075A

United States Patent [19]

Moertle et al.

[11] Patent Number: 6,149,075

[45] Date of Patent: Nov. 21, 2000

[54] METHODS AND APPARATUS FOR SHIELDING HEAT FROM A FUEL NOZZLE STEM OF FUEL NOZZLE

[75] Inventors: George E. Moertle; Edward C. Vickers, both of Cincinnati; Scott Brensike, Reading; Clifford S. Creevy, Loveland; Peter W. Mueller, Morrow, all of Ohio

[73] Assignee: General Electric Company, Cincinnati, Ohio

[21] Appl. No.: 09/390,973

[22] Filed: Sep. 7, 1999

[51] Int. Cl.[7] ..... B05B 15/00

[52] U.S. Cl. ..... 239/132.3; 239/397.5; 60/740; 60/742

[58] Field of Search ..... 239/397.5, 128, 239/132, 132.3, 13; 60/740, 742, 748, 737, 39.094

[56] References Cited

U.S. PATENT DOCUMENTS

| | | | |
|---|---|---|---|
| 1,908,066 | 5/1933 | Sedlmeir | 239/128 |
| 3,662,959 | 5/1972 | Sample, Jr. | 60/39.094 |
| 5,269,468 | 12/1993 | Adiutori | 239/397.5 |
| 5,570,580 | 11/1996 | Mains | 60/742 |
| 5,579,645 | 12/1996 | Prociw et al. | 60/740 |
| 5,598,696 | 2/1997 | Stotts | 60/740 |
| 5,701,732 | 12/1997 | Nesbitt et al. | 60/39.094 |
| 5,761,907 | 6/1998 | Pelletier et al. | 60/740 |
| 5,988,531 | 11/1999 | Maden et al. | 60/740 |
| 6,003,781 | 12/1999 | Kwan | 239/128 |

*Primary Examiner*—Andres Kashnikow
*Assistant Examiner*—Dinh A. Nguyen
*Attorney, Agent, or Firm*—Andrew C. Hess; Rodney M. Young

[57] ABSTRACT

A fuel nozzle including a nozzle stem having an annular overhang and a heat shield secured to the overhang is described. More specifically, and in one embodiment, the nozzle stem includes an upstream end and a downstream end. The annular overhang is intermediate to the upstream end and the downstream end of the stem. The heat shield includes a first end and a second end, and the heat shield is welded to the annular overhang at the heat shield first end. An annular air gap is between the nozzle stem and the heat shield.

8 Claims, 3 Drawing Sheets

METHODS AND APPARATUS FOR SHIELDING HEAT FROM A FUEL NOZZLE STEM OF FUEL NOZZLE

BACKGROUND OF THE INVENTION

This invention relates generally to gas turbine engines and, more particularly, to a heat shield for a fuel nozzle.

Fuel nozzles in gas turbine engines provide fuel to a combustion chamber. The nozzles typically transport fuel through a compressor exit flow path. Temperatures around the fuel nozzle at the compressor exit flow path can exceed 1000 degrees Fahrenheit. The high temperatures around the fuel nozzle can cause the fuel passing through an inner passageway of the fuel nozzle to form granules of carbon on the walls of the inner passageway, which is undesirable. In addition, when the temperature of the fuel reaches approximately 300 degrees Fahrenheit, the fuel may begin to vaporize in the inner passageway, thereby resulting in intermittent or non-continuous fuel delivery to the downstream end of the fuel nozzle.

At least some known fuel nozzles include a heat shield which surrounds a nozzle stem of the fuel nozzle and which cooperates with the nozzle stem to define an annular air gap between the heat shield and the nozzle stem. One such known heat shield is described in U.S. Pat. No. 5,269,468, which is assigned to the present assignee. The heat shield and air gap insulate the fuel nozzle from the high temperatures. The heat shield may be attached to the fuel nozzle body by brazing. Low cycle fatigue (LCF) in braze attachments, however, adversely impacts the life of the shield.

BRIEF SUMMARY OF THE INVENTION

A fuel nozzle including a nozzle stem having an annular overhang and a heat shield secured to the overhang is described. More specifically, and in one embodiment, the nozzle stem includes an upstream end and a downstream end. The annular overhang extends from the upstream end of the stem.

The heat shield includes a first end and a second end, and the heat shield is welded to the annular overhang at the heat shield first end. An annular air gap is between the nozzle stem and the heat shield, and the heat shield second end cooperates with the downstream end of the nozzle stem to form an annular opening for permitting air to pass into and out of the air gap.

DETAILED DESCRIPTION OF THE INVENTION

Figure 1:
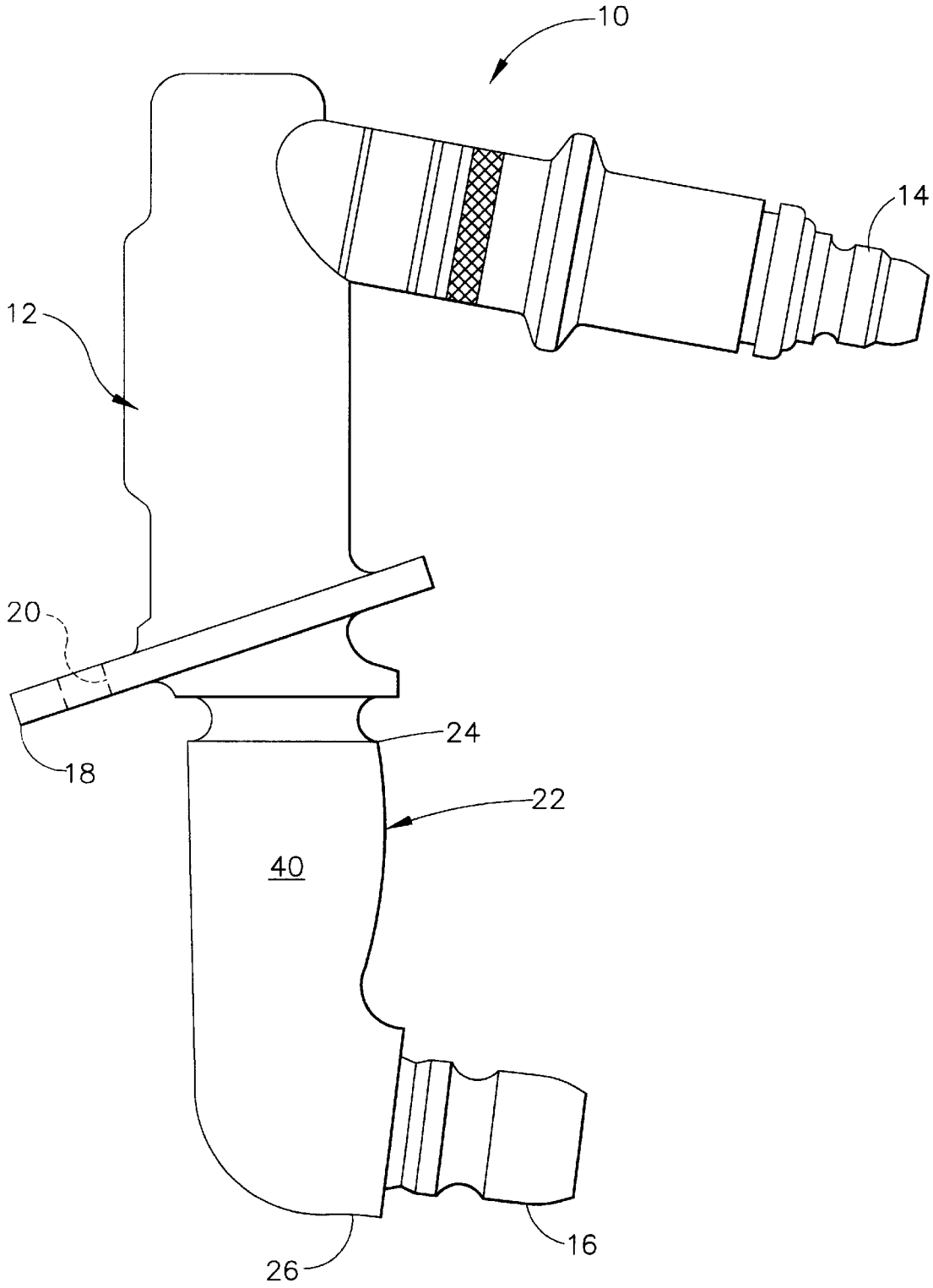
FIG. 1 is a side view of a fuel nozzle.

FIG. 1 is a side view of a fuel nozzle 10. Nozzle 10 includes a nozzle stem 12 which is generally U-shaped and which has an upstream end 14 and a downstream end 16. Nozzle stem 12 also includes a mounting bracket 18 integrally formed as part of nozzle stem 12. Mounting bracket 18 includes an aperture 20 for mounting fuel nozzle 10 to a combustor apparatus (not shown) of a gas turbine engine. Upstream end 14 is configured to be coupled to a supply source of fuel (not shown) and downstream end 16 is configured to be positioned in an operative relationship with a combustor dome assembly (not shown) of the combustor apparatus.

Fuel nozzle 10 also includes a tubular heat shield 22 having a first end 24 which is secured to stem 12 intermediate upstream end 14 and downstream end 16. Heat shield 22 also has a second end 26 operatively associated with downstream end 16.

Figure 2:
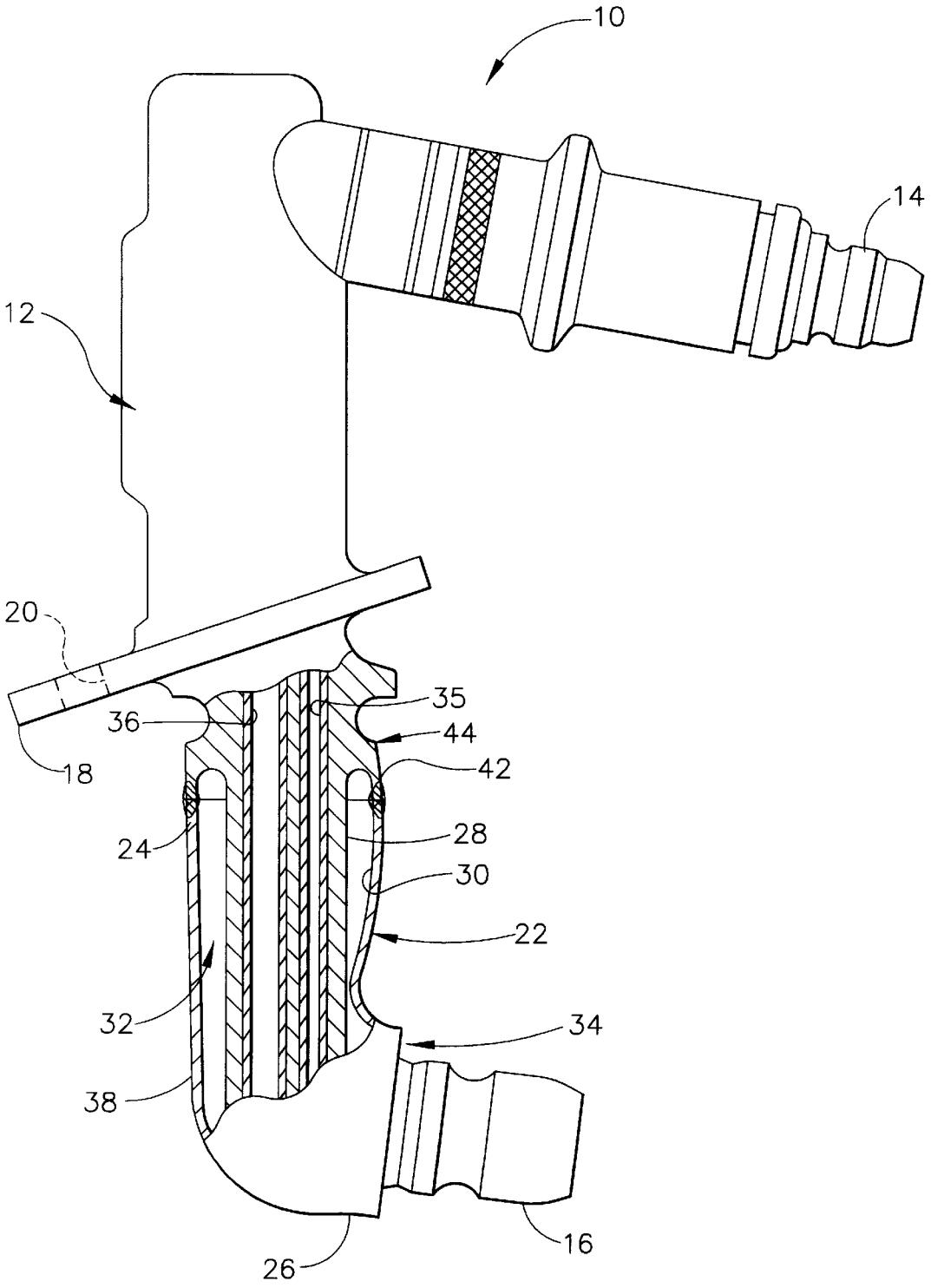
FIG. 2 is a fragmentary view of the fuel nozzle shown in FIG. 1.

FIG. 2 is a fragmentary view of fuel nozzle 10 shown in FIG. 1. As illustrated in FIG. 2, tubular heat shield 22 is generally cylindrical in shape and surrounds nozzle stem 12. Shield 22 has a generally circular cross sectional shape. Nozzle stem 12 includes an outer surface 28 which cooperates with an inner surface 30 of heat shield 22 to define an annular air gap 32 about nozzle stem 12. Second end 26 of heat shield 22 cooperates with downstream end 16 to define an annular opening 34 which opens into air gap 32 in order to permit air or other gases (not shown) to pass into and out of air gap 32. Fuel nozzle 10 also includes primary and secondary fuel passageways 35 and 36 for permitting fuel to pass from upstream end 14 to downstream end 16.

Heat shield 22 includes a first section 38 and a second section 40 (shown in FIG. 1). First section 38 is seam welded to second section 40, as described below in more detail. Also, shield 22 is butt welded at shield first end 24 to a first end 42 of an annular overhang 44 intermediate ends 14 and 16.

Figure 3:
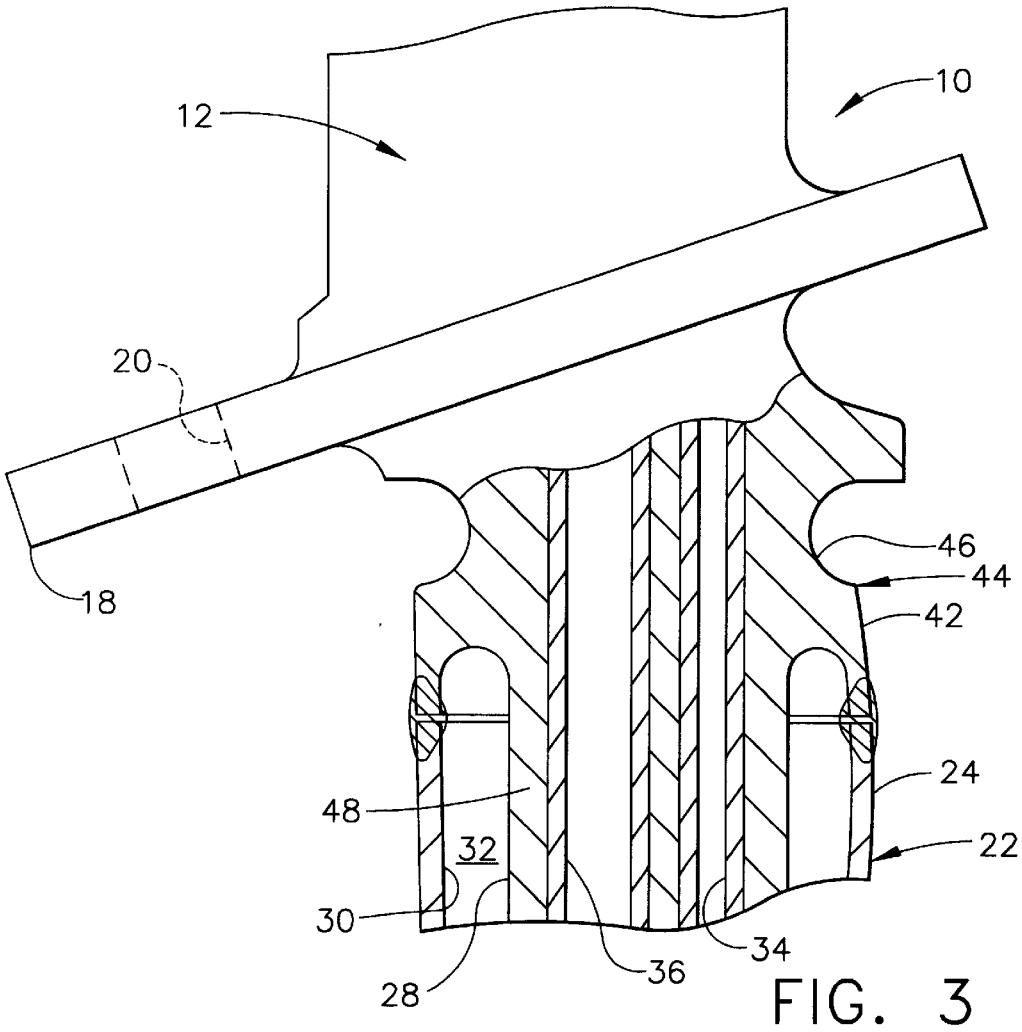
FIG. 3 is an enlarged view of a section of the fuel nozzle shown in FIG. 2.

More specifically, and referring to FIG. 3 which is an enlarged view of a section of fuel nozzle 10 shown in FIG. 2, a thickness of first end 42 of annular overhang 44 is less than a thickness of a second end 46 of overhang 44 at a main body section 48 of stem 12. Heat shield 22 is welded to overhang 44 at overhang first end 42.

Figure 4:
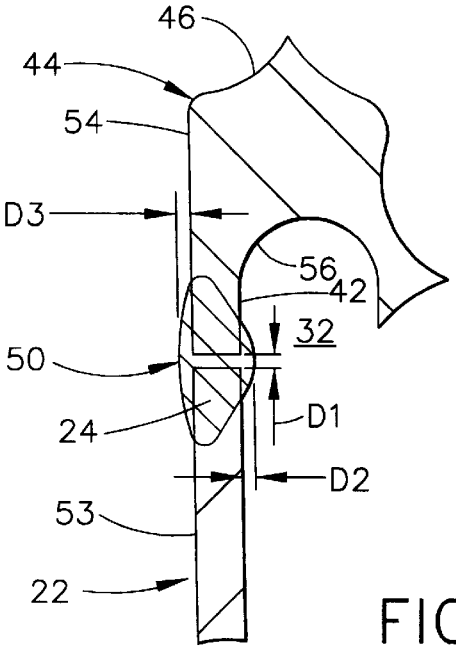
FIG. 4 is a view of a weld between an overhanging section and a heat shield of the fuel nozzle shown in FIG. 3.

FIG. 4 is a view of a weld 50 between overhang 44 and heat shield 22 of fuel nozzle 10. As shown in FIG. 4, first end 42 of overhang 44 is adjacent first end 24 of shield 22, and a suitable filler material 52 (such as Inconel 625 or Hastalloy X) is located between and overlaps first ends 24 and 42. Shield first end 24 is spaced from overhang first end 42 by a distance D1. Filler material 52 extends within annular air gap 32 by a distance D2, and extends beyond outer surfaces 53 and 54 of shield 22 and overhang 44, respectively, by a distance D3. Exemplary values of D1, D2, and D3 are set forth below. Of course, the distance may vary depending on the particular application and materials utilized.

D1=0.025"

D2=0.030"

D3=0.030"

Machining an annular groove 56 in stem 12 forms overhang 44. More specifically, groove 56 is formed by mounting stem 12 on a lathe and using a cutting tool to form groove 56 while stem 12 is spinning. Stem 12 typically is fabricated from Inconel 625, and known trepanning machines can be used to form groove 56 in stem 12. Heat shield 22 is then welded to overhang 44 by locating heat shield sections 38 and 40 adjacent end 42 of overhang 44, and inserting a filler ring at the interface between ends 24 and 42 as shown in FIG. 4. A butt weld is then formed using an automated butt welding machine to secure shield 22 to overhang 44. Automated butt welder machines are known. A seam welder is then utilized to weld first shield section 38 to second shield section 40 at the interfaces between sections 38 and 40.

The overhang permits the maximum stress, which occurs in the weld and which results from thermal gradients generated during normal engine operation, to be relocated to overhang 44 which is a region of controlled geometry, parent metal properties, and away from the weld which has indeterminate geometry, reduced material properties, and inherent internal defects. By machining the overhang into the stem of the fuel nozzle, and by tapering the overhang thickness such that the end of the overhang welded to the shield is thinner than the end of the overhang at the stem main body, the thermal stresses in the overhang are minimized. Such lower stresses result in longer fatigue life. Further, the machined groove enables use of an automated butt weld, which is precise, controlled, and robust. In addition, the machined groove also enables control of thermal stresses around the machined trepan radius and the tapered overhang cross section. The machined trepan groove also facilitates precise centering of the heat shield on the fuel nozzle housing.

While the invention has been described in terms of various specific embodiments, those skilled in the art will recognize that the invention can be practiced with modification within the spirit and scope of the claims.

What is claimed is:

1. A fuel nozzle comprising:

a nozzle stem comprising an upstream end and a downstream end, at least one fuel passageway therethrough for permitting fuel to pass from said upstream end to said downstream end, and an annular overhang intermediate said upstream end and said downstream end;

a heat shield secured to said overhang, said nozzled stem, said heat shield, and said annular overhang defining an air gap surrounding said nozzle stem.

2. A fuel nozzle in accordance with claim 1 wherein said annular overhang comprises a first end and a second end at a main body section of said stem, said heat shield welded to said overhang at said overhang first end.

3. A fuel nozzle in accordance with claim 2 wherein said second end has a greater thickness than said first end.

4. A fuel nozzle in accordance with claim 1 wherein said heat shield comprises a first section and a second section, said first section welded to said second section.

5. A fuel nozzle in accordance with claim 1 wherein said heat shield is butt welded to said overhang.

6. A fuel nozzle for use in a gas turbine engine, said fuel nozzle comprising:

a nozzle stem comprising an upstream end and a downstream end, at least one fuel passageway therethrough for permitting fuel to pass from said upstream end to said downstream end, and an annular overhang intermediate said upstream end and said downstream end, said overhang comprising a first end and a second end, said overhang second end having a greater thickness than said overhang first end;

a heat shield comprising a first end and a second end, said heat shield welded to said annular overhang first end at said heat shield first end, said heat shield having a circular cross sectional shape, said annular overhang, said heat shield, and said nozzle stem defining an air gap, said heat shield second end cooperating with said downstream end of said nozzle stem to form an annular opening for permitting air to pass into and out of said air gap.

7. A fuel nozzle in accordance with claim 6 wherein said heat shield comprises a first section and a second section, said first section welded to said second section.

8. A fuel nozzle in accordance with claim 6 wherein said heat shield is butt welded to said overhang.

* * * * *